US005083410A

United States Patent [19]

Watson

[11] Patent Number: 5,083,410

[45] Date of Patent: Jan. 28, 1992

[54] SYSTEM FOR THE CONSTRUCTION OF EMERGENCY HOUSING

[76] Inventor: James F. Watson, #240 Calle Cemlo,, La Guacima de Alajuela, Costa Rica

[21] Appl. No.: 373,213

[22] Filed: Jun. 28, 1989

[51] Int. Cl.[5] ..... E04C 2/54

[52] U.S. Cl. ..... 52/78; 52/481; 52/282

[58] Field of Search ..... 52/777, 780, 781, 238.1, 52/241, 242, 481, 281, 282, 303, 763, 764, 766, 770, 275

[56] References Cited

U.S. PATENT DOCUMENTS

| | | | |
|---|---|---|---|
| 2,058,386 | 10/1936 | Parsons | 52/241 |
| 2,399,151 | 4/1946 | Tickle, Jr. | 52/481 |
| 3,151,711 | 10/1964 | DeRidder | 52/481 X |
| 3,992,839 | 11/1976 | LaBorde | 52/282 X |
| 3,996,712 | 12/1976 | Howell | 52/481 X |
| 4,458,462 | 7/1984 | Schold | 52/281 X |
| 4,854,096 | 8/1989 | Smolik | 52/241 |

*Primary Examiner*—Richard E. Chilcot, Jr.
*Assistant Examiner*—Creighton Smith
*Attorney, Agent, or Firm*—William F. Frank

[57] ABSTRACT

Formable sheet metal or other formable material having similar characteristics, such as poly vinyl chloride, constitute practically the only components required to fabricate a light-weight, packageable and easily transportable building herein described. Being light-weight, the building structure does not require a massive, expensive foundation. The entire structure can be quickly erected by unskilled labor using a simple pair of pliers. All components can be fabricated in most cases without special machinery and they are all then snapped together or connected with integral pre-formed or formable fasteners, with only one exception: toggle screws used to fasten the combination ventilation/illumination panels to the standing seams of the roof panels and to fasten rain caps to the ridges of gabled roofs. The finished structure is rigid, self-supporting, resistant to high wind forces, water-tight and protective from the elements.

To fill the requirements for an emergency shelter, the present design permits the rapid erection of a building, using only one panel of a double panel wall system, thus providing a simple shelter without water, sanitation or electrical facilities. However, as time and financing permit, this simple shelter can be easily converted to a permanent, more comfortable facility by installing utilities and insulation between the double panel wall system before snapping into place the second (interior) panel. This follow-on construction concept will obviate the cost of replacing the entire emergency shelter with a second, more expensive permanent structure. Some of the wall panel designs described herein provide the option of using as the second finishing (interior) panel such lamina as gypsum drywall, particle board, plywood or any other desired materials. These optional panel finishings may be either snapped into place or fastened to the interior ribs to complete the double wall system.

Because climates, manufacturing facilities and the availability of materials vary the world over, a single facility design would not adapt to all the variables imposed by local conditions. Therefore, this inventor has applied the basic snap-together techniques described herein to several designs that will more universally extend the benefits of these construction techniques.

3 Claims, 9 Drawing Sheets

SYSTEM FOR THE CONSTRUCTION OF EMERGENCY HOUSING

BACKGROUND

There is a world-wide need for more adequate, low-cost housing—especially emergency housing to shelter disaster victims who have lost their homes to hurricanes, earthquakes, floods, or loss of income. The ultimate cost of providing for these homeless can be dramatically minimized if the emergency housing available to them can be later converted economically into permanent, comfortable housing as time and financing permit. The present designs described herein will make this conversion viable. The present invention—when converted from a temporary, emergency shelter into a permanent structure—will meet most land restrictions, building codes, sanitary standards and energy efficiency standards. This inventor believes that his improvements in the construction arts will permit the construction of adequate housing for the disadvantaged and homeless at low cost using widely available materials and simple techniques requiring little or no skilled labor. Hopefully, even better low cost housing than this present invention will be achieved in the future as new materials and methods based on the present invention are developed. Possibly even more important will be the change in the mind-set of the human populace with respect to the external appearance of a dwelling. In the past, attempts to employ materials such as styrofoam and gunite-applied concrete to provide rapidly constructed, economic structures were negated owing to the non-conventional external appearance of such structures. Even more illustrative is the history of the Quonset Hut which, while functional and low cost, is rarely used in residential areas because is doesn't look like a conventional house.

There are many panel-type building systems. However, to my knowledge, none of them provide the quick snap-together efficiency from the base to the finished roof as is embodied in this invention. Nor are the assembly techniques as simple so that they may be used by unskilled laborers employing one or two simple, common tools. Furthermore, all other snap-together panel systems of which I am aware unfortunately allow slippage between their longitudinal axes unless they are bolted, screwed or riveted to some other stabilizing part. In some of these designs when slippage is not controlled, a force such as a wind load can cause the walls to rack.

This undesirable feature is found in conventional construction wherein 2"×4" vertical supporting wood studs are sheathed with 1"×6" tongue-and-groove siding material; in order to control said slippage between the sheathing under high wind loads, diagonal sway bracing is employed. This condition is also corrected in conventional construction by using plywood sheathing nailed to the vertical supporting studs so that when a torque load created by wind force is applied to the wall, the entire cross-section of the plywood is placed into a state of compression and tension, thereby successfully resisting the torque caused by the wind force. This latter force-resistant construction technique resembles the physics inherent in the panel system herein described. That is, the snap-together panel system here present provides fasteners across the top and bottom of the panels, thus placing the cross-section of the central plane of the panel—further reinforced by its formed longitudinal edges that form the snap-together seams—into a state of compression and tension, thereby resisting undesirable torque loading that could otherwise cause structural failure.

SUMMARY

This present invention relates to a procedure of fastening channels to a base or foundation so as to define the peripheries of the exterior and interior walls of a building. These bottom channels have their flanges turned upward and the flanges provide the means of snap-fastening the subsequent wall panels to each other. When all the required wall panels are in place, a top channel—with its flanges turned downward—is snap-fastened to the tops of the wall panels. The top channel aligns the top of the wall and provides the means of connecting the roof panels to the wall panels.

The roof panels vary in function and design so as to provide combinations of security against the weather: illumination, ventilation, and a means of utilizing the sun's rays to heat water. These roof panels embody the same basic parts of channels and panels as the wall panels and are assembled with the same snap-together fasteners.

Each wall or roof section of a structure consists of a bottom channel, a multiple of adjacently disposed panels and a top channel. The bottom channel has upturned flanges and one flange has intermittently spaced recesses on prescribed centers. The wall panels have a length equal to the height of the wall and a width which, in most cases, is approximately one-sixth to one-quarter of the wall height. The panels have a plane central portion with a flange or some other device that acts as a separator turned at right angles to the plane central portion along its longitudinal edge. These flanges or separators have slots at both ends lateral to the longitudinal edges of the plane central portion and one side of these slots is adjacent to the inner side of the plane central portion. These slots are demensioned to fit snuggly over the thickness of the flanges of both the top and bottom channels.

There are tongues near the narrow ends of the plane central portion of the panels whose centers coincide with the prescribed centers of the recesses in the channel flanges. When the panel slots are forced over the channel flange that has the recesses, the tongues in the panel that protrude from the plane central portion of the panel at a sliding angle, deform the panel sufficiently to permit the intrusion of the tongue into the recess in the channel flange and the direction of the tongue is such that it acts as a barb and resists withdrawal as long as the panel slots hold the panel and channel together. It is important to note that the security of this snap-in connection depends on the tongue being located as close as possible to the juncture of the plane central portion of the panel and its flange or separator.

The top channel in a wall section has recesses on prescribed centers in its web between its two flanges. The roof panels have formable tongues on their underside at both narrow ends on the same prescribed centers as the recesses in the channel. When the roof panels with their inner panel facing downward are placed on the top of the walls with their extreme ends supported on opposing walls, the tongues are placed in the recesses in the web of the channels and formed back on the underside of the channel web. Where a central box beam is employed as a support for one end of the panels, the box beam has a flange with recesses to receive the tongues.

When openings in the roof panels are desired for illumination and ventilation, they are created by using shortened sections of panels at both ends, leaving an opening in the panel toward the center and framing the opening with the same type of channel that is used for the bottom and top channels. Translucent plastic panels wide enough to bridge the width of the roof panel, and with down-turned flanges on each side of the panel's width—deep enough to provide attachment to the outer sides of the standing seams—are fastened to the standing seams with toggle screws. On a flat roof, these translucent panels would have to be long enough to cover the full length of the roof panel. On a sloped roof, the translucent panel should extend from a point under the roof cap at the high point to a point sufficiently below the opening in the roof to prevent wind-blown rain intruding into the opening.

Solar heating panels are snapped into the roof panels in the same manner as the outer roof panels.

On sloping roofs, rain caps are fastened to the box beam at the high point of the roof with toggle screws inserted into pre-drilled holes in the box beam.

DESCRIPTION OF DRAWINGS

All the development work on this invention was based on the premise that a light gauge metal would be the best material for the ultimate production of the components. Therefore, all models actually constructed at full scale in order to prove the designs consisted of 26-gauge galvanized steel. Since it would not be practical to make these drawings here present to scale, it was necessary to distort the illustrated thicknesses of the metal so that the various forms would be more distinct and easier to interpret visually.

DETAILED DESCRIPTION OF DRAWINGS

Figure 1:
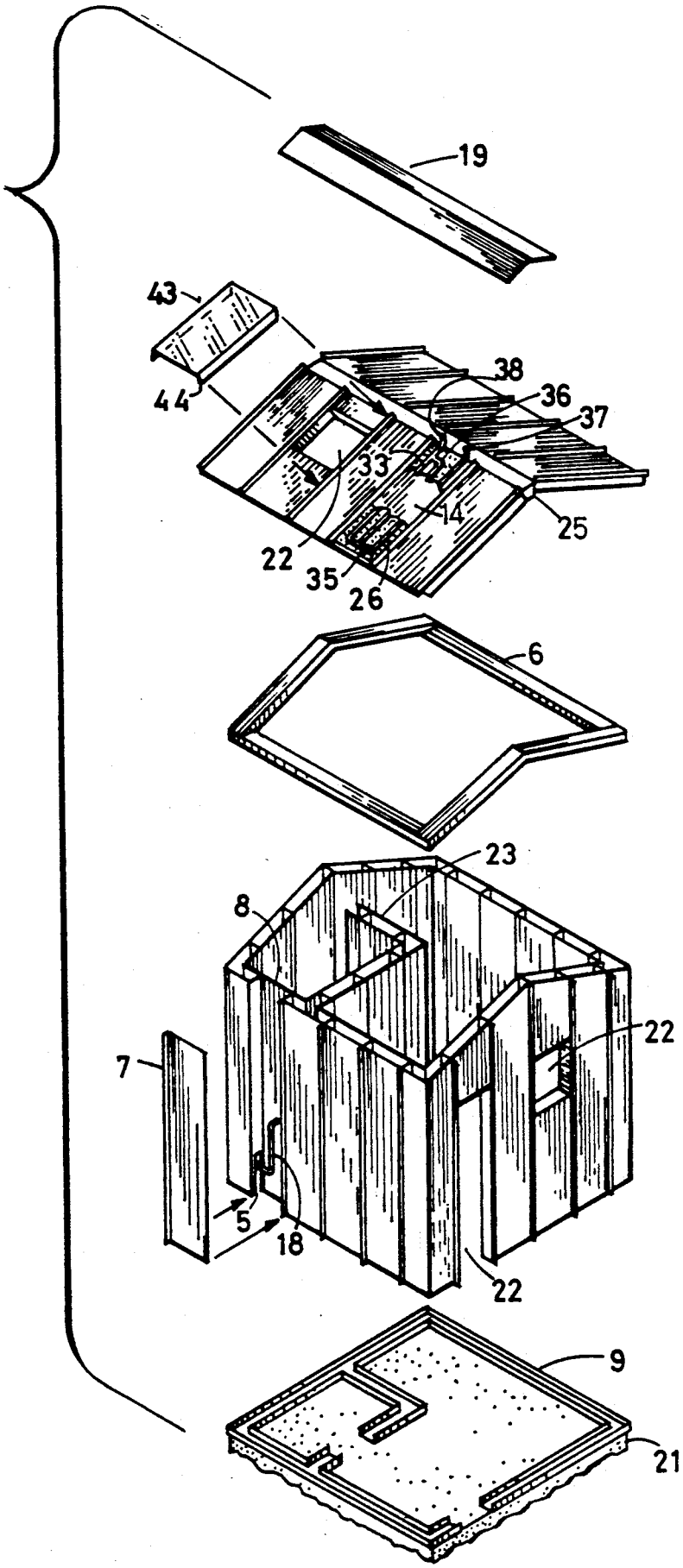
FIG. 1 An exploded isometric of a simple structure embodying the basic forms and phases of assembly of the present invention.

FIG. 1 illustrates in isometric and exploded form an assembly which embodies the basic concepts of this invention. The lower part of the illustration shows the first phase of assembly where the bottom channel 9 with upturned flanges is fastened to a base 21 which define and align the walls. The base should preferably be something solid such as concrete; however, in some emergency situations it may be only leveled earth. The type of base the structure is erected on will determine which type of fastener 39 should be used.

Immediately above the base is shown a simple structure merely to illustrate the arrangement and relationship of the outside panels 7, inside panels 8 and interior partition panels 22. These panels are snapped onto the bottom channels and are types shown in FIGS. 9, 12, 13, 16, 18, 20, 23 and 25. The exploded view of the outside panel 7 reveals the access to the interior of the wall before the outside panel is snapped into place and also shows the raceway 5 that permits the installation of the utilities 18. Also shown is how short sections of wall panels create openings 42 for door and window frames. Directly above the wall panel illustration is shown the top channel 6 with flanges turned downward that are snapped onto the tops of the wall panels. The roof panels shown directly above the top channels are one of the various types shown in FIGS. 16, 18, 20, 23 or 25. All roof panels are assembled snapped together with top and bottom channels in the same manner as the wall panels. Short sections of the panels are used to create openings 22 for translucent plastic panels 43 that have down-turned flanges 44 on two parallel sides which are equal in height to the height of the roof panel standing seams. These panels, when set over the roof panel standing seams, bridge over the seams and create an air passage between the top of the roof panel and the translucent panel 43 which allows the air to circulate, drawing air from the interior of the structure through the opening 22 in the roof. The translucent panel extends from below the opening sufficiently to prevent the intrusion of wind-blown rain and to a point above the opening 22 where it terminates under the rain cap 19 at the high point of the roof. Solar heater panels that snap into place are constructed by fixing metal tubes to the underside of an outer roof panel 7 plane central portion 14 and providing a cold water connection 37 to a cold water manifold 35 that feeds heat transfer tubes 33 into the hot water manifold 36 and a hot water connection 38. By filling the panel 7 cavity below the collector tubes with insulating material 26, a very efficient water solar heater can be made.

Figure 2:
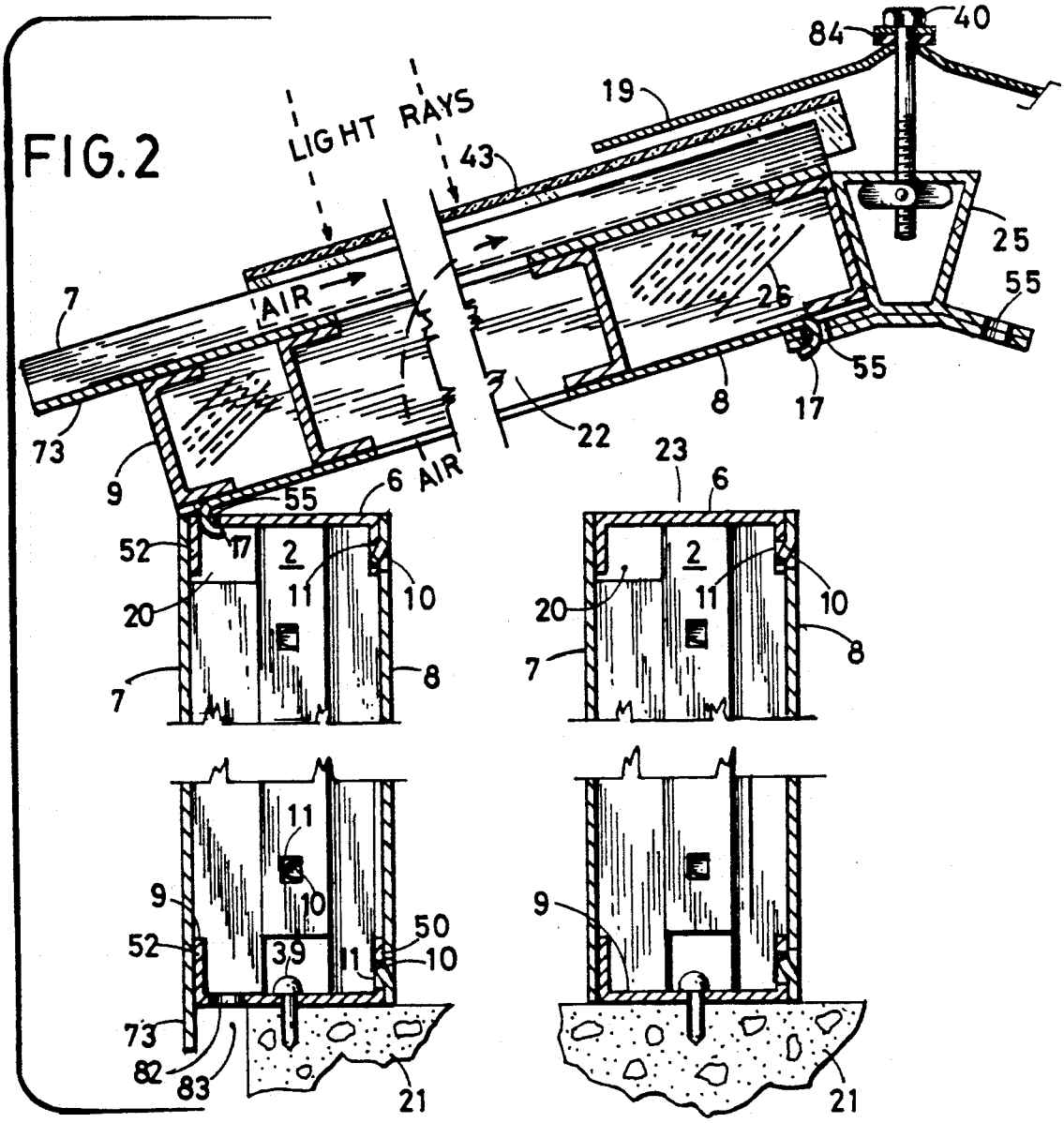
FIG. 2 A sectional drawing of the exterior walls, interior walls and a roof structure.

Flat roofs are made by supporting the extreme ends of the panels between opposing walls. Gabled roofs are constructed by supporting the low end of a roof panel on a wall and the high point of the gable on a box beam 25, fastening the extreme ends of the roof ranels to the supporting members with formable tongues 17 in the recesses 55 in the top channels 6 as shown in FIG. 2. When the roof has been completely installed, the rain cap 19 is fastened to the box beam 25 with toggle screws 40 and sealed with a packing washer 84 as shown in FIG. 2.

FIG. 2 shows an exterior wall at the left-hand side of the drawing with the bottom channel 9 mounted on the base 21 so that it overhangs the edge of the base to create an air break 83 between the drip edge 73 of the outside panel 7. This air break 83 eliminates the possibility of surface tension carrying water into the structure and also provides a means of draining the wall cavity through the weep holes 82 in the web of channel 9 in case of floods. The illustration to the left in FIG. 2 shows an interior partition where the drip edge 73 of exterior panel 7 is eliminated to accomodate the level base. FIG. 2 shows in both left-hand and right-hand illustrations the interior panel 8 snap-locked into the bottom channel 9 and top channel 6 by means of the tongues 10 in the panels 8 protruding into the recesses 11 in the bottom channel 9 and the top channel 6. When the inside panels 8 are adjacently disposed to complete the walls, the outside panels 7 can be adjacently disposed by snapping them together along their longitudinal edges, and where an exterior panel flange interferes with the flanges 52 of the upper channel 6, a notch 20 is provided in the exterior panel 7 flange. The roof panel cavities may be filled with insulating material 26.

Figure 3:
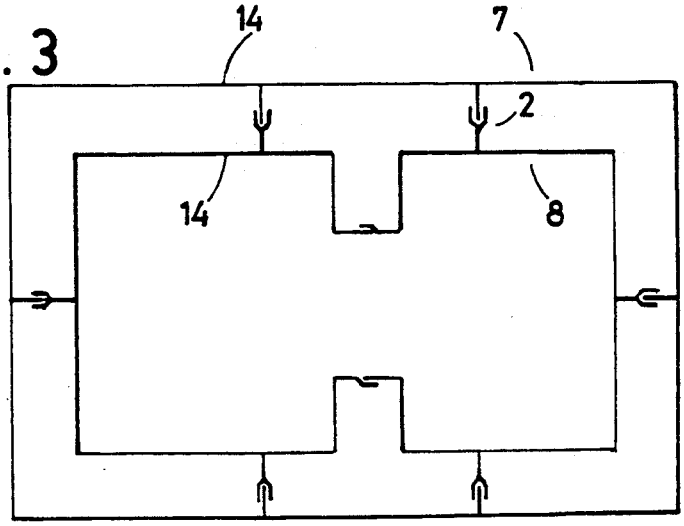
FIG. 3 A plan showing how inside and outside corners can be formed for a structure.

FIG. 3 is a plan of the wall panels 7 and 8 arranged to illustrate how, by forming the plane central portions 14 of the panels, inside and outside corners can be created and the adjustment made in the panels for the difference in length of the inside and outside walls. Separators 2 are shown in detail of the various types of panels in subsequent figures.

Figure 4:
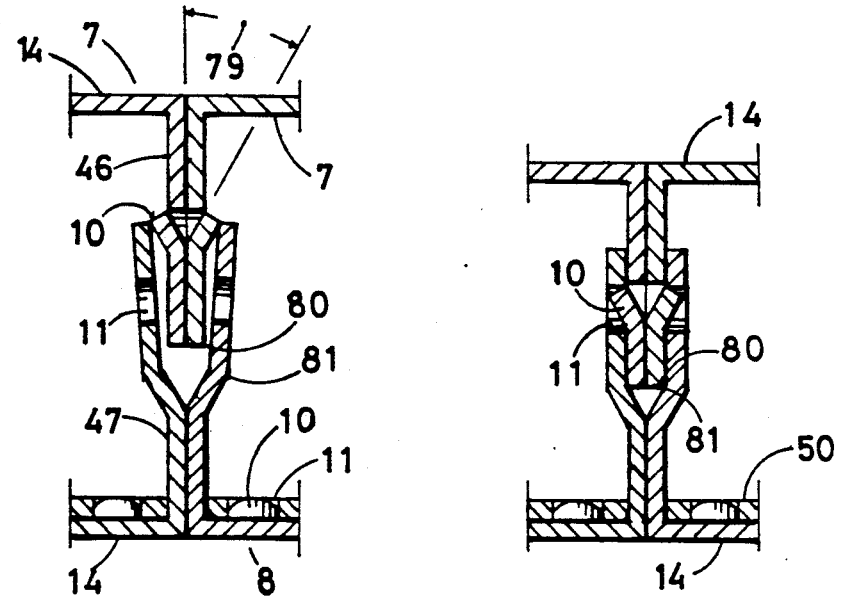
FIG. 4 A tongue and recess fork arrangement.

FIG. 4 illustrates a snap-together device employed in fastening the outside panels 7 to inside panels 8 and serves as a separator 2. The inside panels 8 are held together laterally by the tongues 10 in the plane central portions 14 of the interior panels 8. When the extreme edges 80 of the outside panel 7 flanges 46 are inserted in the forks created by the two adjoining inside panel 8 off-set flanges 47 far enough so that the low sliding angle 79 of the tongues 10 in the flanges 46 force the tines 12 of the fork to spring open sufficiently to allow the tongues 10 to enter the recesses 11 in the forks, as shown in the right-hand illustration. The corners 81 of the offset in the flange 47 prevent any further inward movement of the tips 80 of the flanges 46 and the tongues 10, acting as barbs in the recesses 11, preventing withdrawal of the flanges 46 from the forks.

Figure 5:
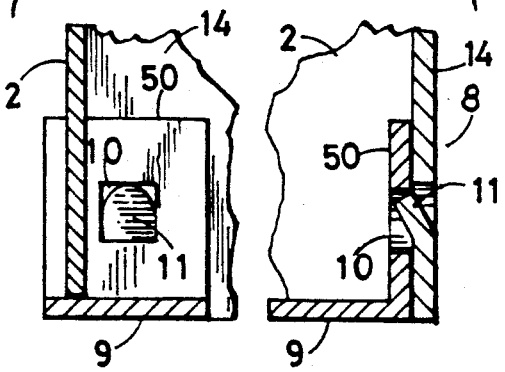
FIG. 5 A tongue and recess to snap-lock two laminas together.

FIG. 5 illustrates how the snap-connection operates when employed between a plane central portion 14 of a panel 8 and a channel flange 50 when held together by panel slots 4 in a panel separator 2. When the slot 4 in the panel separator 2, with one side of the slot adjacent to the plane central portion 14 of the panel 8 is snuggly fitted over the flange 50 of the bottom channel 9 and the bottom of the panel web 2 bottoms against the channel web 15, the tongue 10 in the plane central portion of the panel 14 engages in the recess 11 in the channel flange 50 so that movement up and down and from side to side is restricted.

Figure 6:
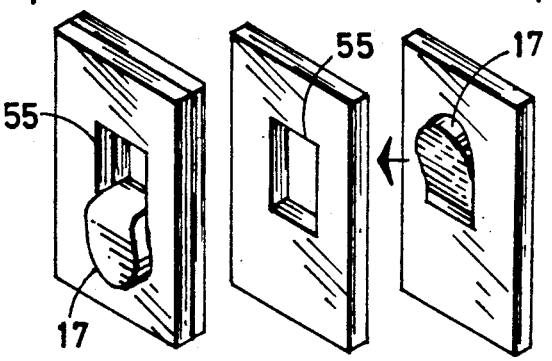
FIG. 6 A formable tongue and recess.

FIG. 6 is an exploded isometric which illustrates how two laminas of material are held together to restrict movement between the two pieces in three directions by a tongue 17 formed from one lamina inserted into a snug-fitting recess 55 in an adjacent lamina and then doubled over the edge of the recess 55 by deforming the tongue 17 and compressing it firmly. This connection is used to fasten roof panels to the top channels 6 of the walls.

Figure 7:
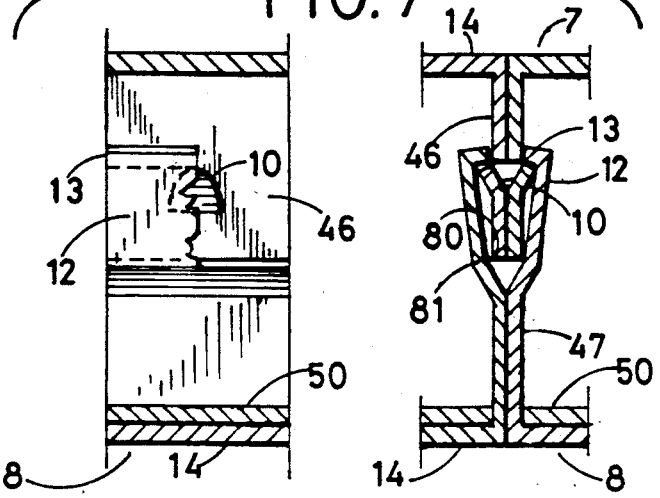
FIG. 7 A snap-lock arrangement of a fork with hooked tines and tongues.

FIG. 7 illustrates a snap-together connection which functions in like fashion to the device shown in FIG. 4, but does not require the precision required to align coinciding tongues 10 and recesses 11 as shown in FIG. 4. The barbs 13 on the tips of the tines 12 are continuous on the longitudinal length of the panel 8. When assembled as shown, the tongues 10 are restricted by the barbs 13 in one direction and the points 80 and 81 in coincidence restrict movement in the opposite direction. This snap-together connection can be substituted for the connection shown in FIG. 4 wherever practical.

Figure 8:
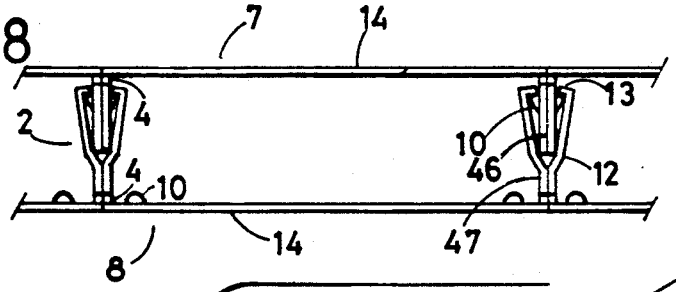
FIG. 8 A plan of box-shaped panels.
Figure 9:
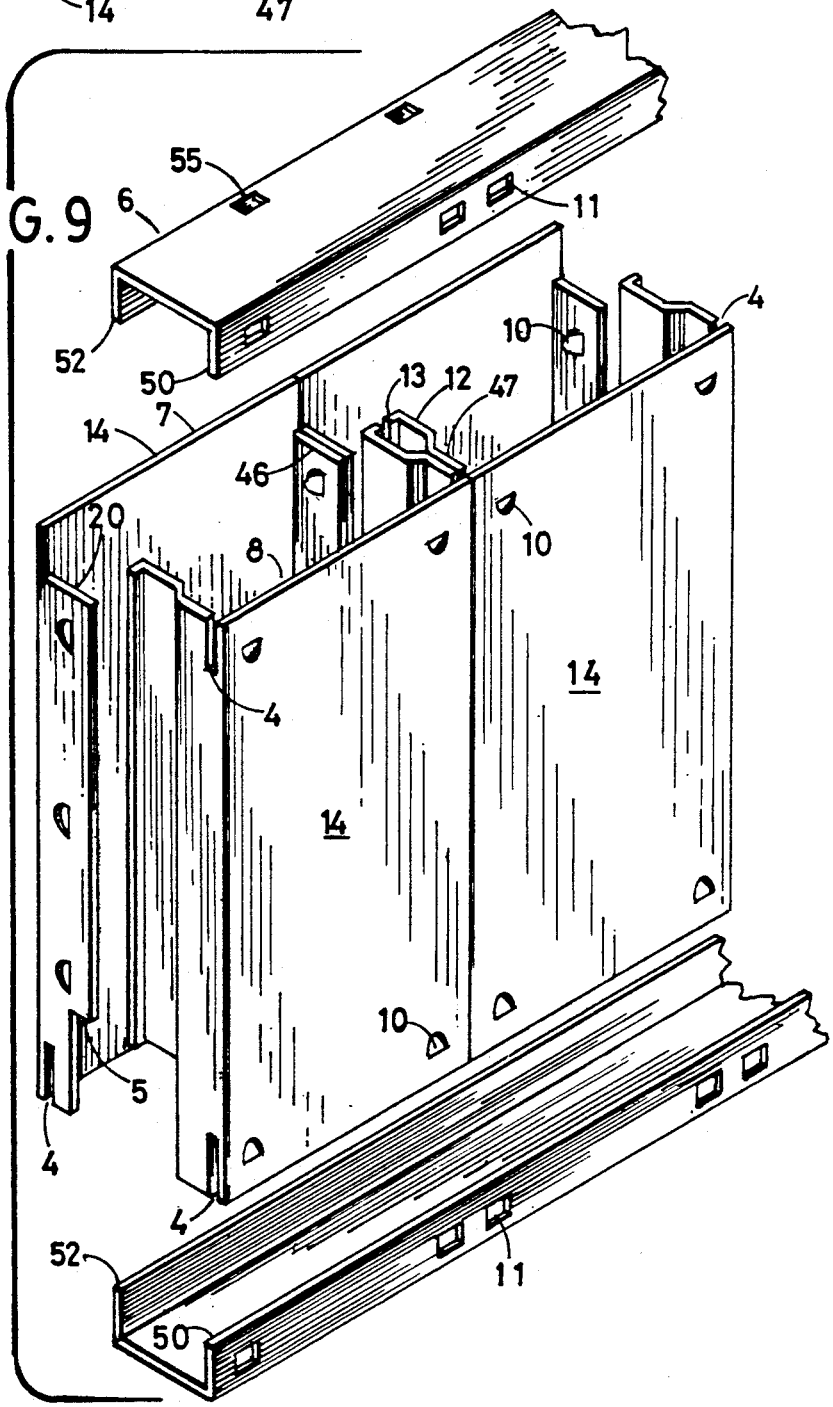
FIG. 9 An exploded isometric of panels shown in FIG. 8 assembled with top and bottom channels.

FIG. 8 is a plan detailing the conformations of panels 7 and 8 as employed in the panel design shown in FIG. 9.

Figure 10:
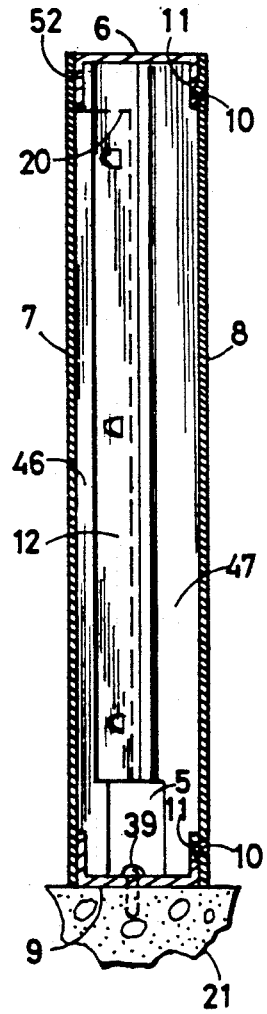
FIG. 10 A section of assembled panels shown in FIG. 9
Figure 17:
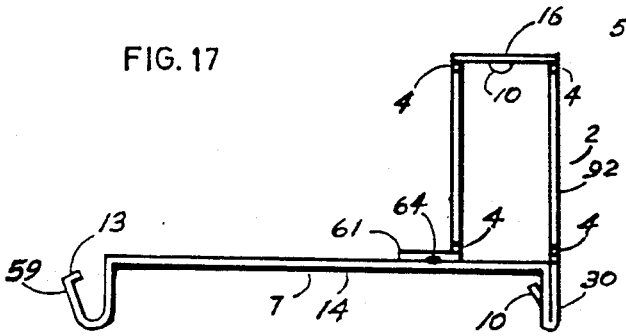
FIG. 17 A plan detailing the conformation of the panel shown in FIG. 16
Figure 19:
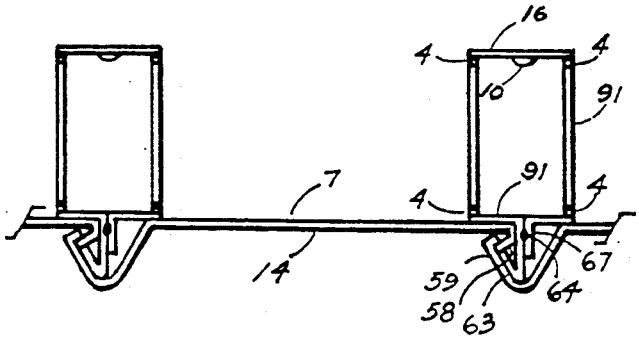
FIG. 19 A plan detailing the conformation and means of snap-connecting the components shown in FIG. 18

FIG. 9 is an exploded isometric that shows the relationship between top channel 6 and the bottom channel 9 with their two side flanges 50 and 52; the interior panel 7; the exterior panel 8 and how they function to create a wall or a roof section when snapped together. What is shown in FIGS. 8, 9, 10 is typical of all the designs shown herein. In FIG. 9 the bottom channel 9 has a right-hand flange 50 and a left-hand flange 52, both turned upward. The right-hand flange 50 has recesses 11 that have a specific distance from the top of the flanges 50 to the top edge of the recess and from the centerline to centerline along the length of the channel flange 50. In the web 15 of the channel are holes for fastening the channel to a base 21 with whatever fastener 39 is required by the base substance. The separators 2 basically act as longitudinal structural members and can be made up of parts of the wall panels 7 and 8 as shown in FIG. 17, or, as an independent member as shown in FIG. 19. FIG. 8 shows the inside panel 8 with a plane central portion 14 with in-turned flanges 47 along the longitudinal edges. The flanges 47 have offset edges 12 terminating in a barb 13 along the longitudinal edge of panel 8. When two or more of the inside panels 8 are adjacently snap-locked onto the bottom channel 9, the two offset edges 12 form forks as described and illustrated in FIG. 7. FIG. 8 shows an exterior panel 7 with a plane central panel 14 that has two inwardly turned plane flanges 46 and these flanges have intermittently spaced tongues 10 that project inwardly. When the panel flanges 46 are forced into the forks formed by flanges 47 of the inside panels 8, the tips of the flanges 47 bottom in the fork and the barbs 13 hook under the tongues 10 so that movement in or out of the two parts is restricted and this combination forms the separator 2 between the inside panels 8 and the outside panels 7.

The inside panel 8 has slots 4 in the flanges 47 which fit snuggly over the flange 50 of the bottom channel 9 with one side of the slot tangent to the plane central portion 14 of the panel 8. The plane central portion 14 of the inside panel 8 has tongues 10 in its four corners protruding inward and the tips of the tongues are precisely positioned so that when the slots 4 in the flange 47 are dropped over the flange 50, the tips of the tongues 10 engage the top edge of the recess 11 in the flange 50 and lock the panel 7 and the channel 9 together, and the snuggly fitting slots 4 over the channel flange 50 maintain this lock.

Following are eight wall and roofing panel designs which have the mutuality of being snap-fastened to bottom channels 9 and top channels 6 in the same manner. Both top and bottom flanges 6 and 9 have in their flanges 50 intermittently and precisely spaced recesses 11 on prescribed centers. The inside wall panels 8 shown in FIGS. 9, 12, 23 have tongues 10 which protrude inward from the corners of the plane central portions 14 of the panels 8 and these tongues 10 with their tips pointing toward the center of the plane central portion 14 are located near the edges of the plane central portions 14 on the same prescribed centers as the recesses 11 in the flanges 50 of channels 6 and 9. In the flanges of panel 8 that are turned inward from the plane central portion 14 are slots 4 in the transversal ends of the panel 7 that have one side of the slot adjacent to the inner face of the plane central portion 14 and the width and depth of these slots 4 provide a snug fit over the thickness and depth of the flanges 50 of the channels 6 and 9. The panel shown in FIG. 13 has tongues 10 at the extreme ends of the back-up flanges 53. The panels shown in FIG. 20 and FIG. 25 have these tongues at the extreme ends of their flanges 16. All the panels shown in FIGS. 13, 16, 20, 25 have slots 4 at the extreme ends of the panels—as shown in these drawings—that permit the slots to be slipped over channel flanges 50 and 52 and thus engage the tongues 10 in the recesses 11 in the channel flanges 50 and 52.

FIG. 9 shows the top channel 6 with the downturned flanges 50 and 52. The top channel flange 50 has the same precisely centered recesses 11 as the bottom channel 9 and when all the inside channels 8 are adjacently disposed on the bottom channel 9, the top channel 6 can be snap-fastened to the tops of the inside panels 8 by forcing the channel flanges 50 and 52 into the slots 4 at the tops of the panels 8. The recesses 55 in the web 15 of the top channel 6 are precisely spaced for attaching the roof panels that have coinciding tongues 17 shown in FIG. 6.

FIG. 10 is a section which illustrates how the notch 20 allows the flange 46 to clear the flange 52 when assembling an exterior panel 7. The notches 5 in the flange 46 provide the raceway for running the utilities from panel to panel.

Figure 11:
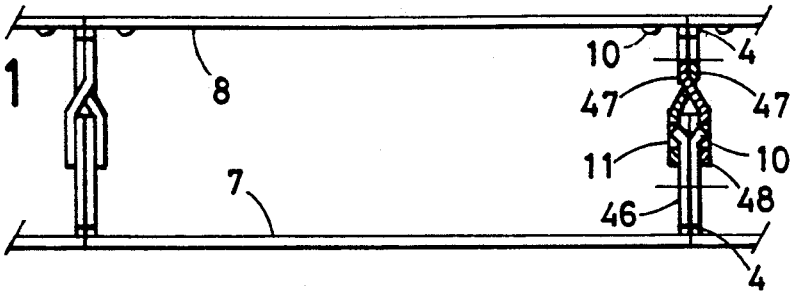
FIG. 11 A plan of two channel shapes snapped together to make a wall module.
Figure 12:
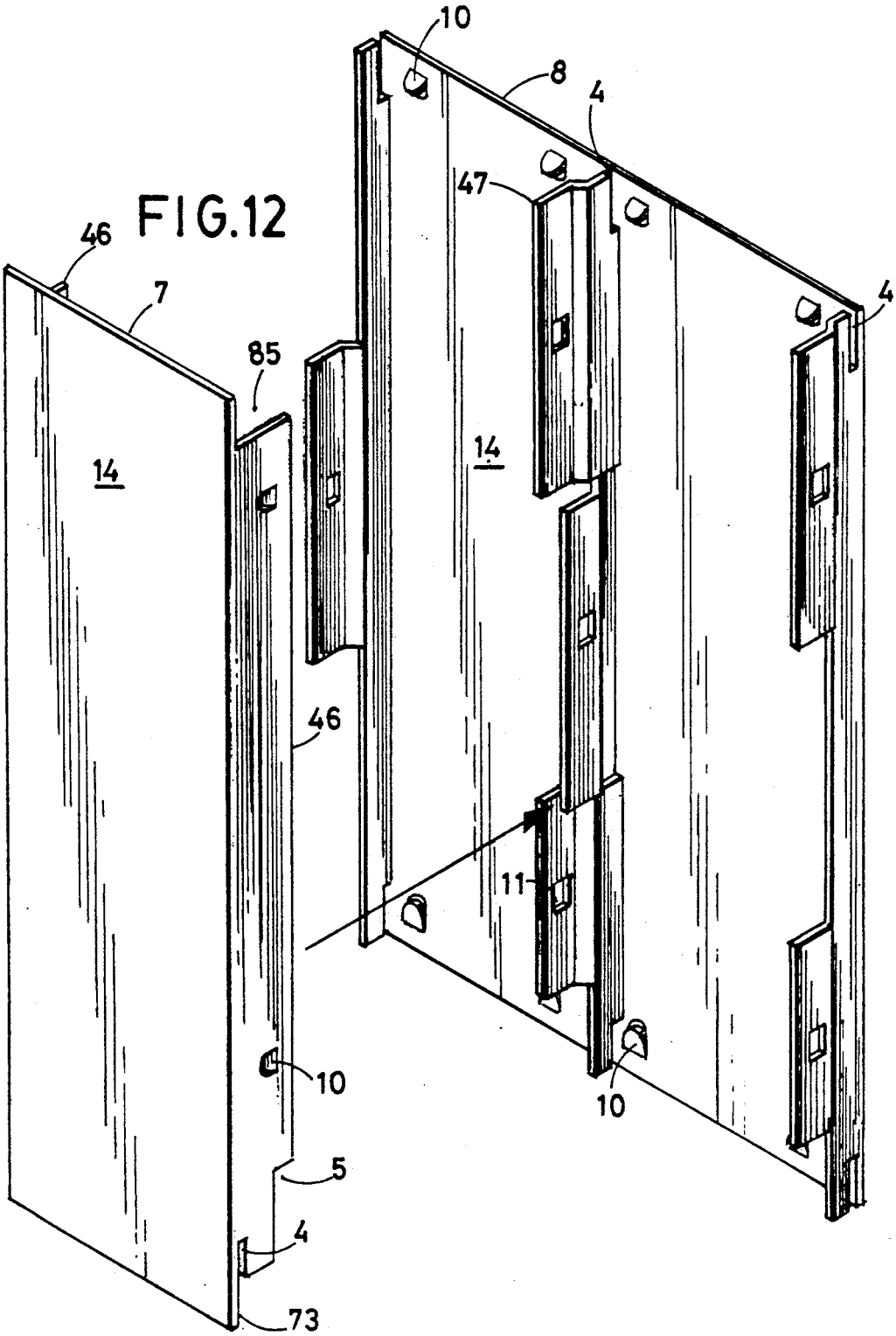
FIG. 12 An exploded isometric view of the panels shown in FIG. 11

FIG. 11 is a plan of the panels shown in the isometric FIG. 12 which shows the snap-lock connection between the crossed-over flanges 47 of the inside panels 8 and the adjacent plane flanges 46 of the outside panel 7.

FIG. 12 also shows alternately notched flanges 47 that are offset on their extreme edges 48 so that when the panels 8 are adjacently disposed on the bottom channel 9, the alternate notches create forks into which the flanges 46 of the outside panel can be inserted to engage the tongues 10 in the recesses 11, locking the flanges 46 and 47 together and creating a separator 2.

Figure 13:
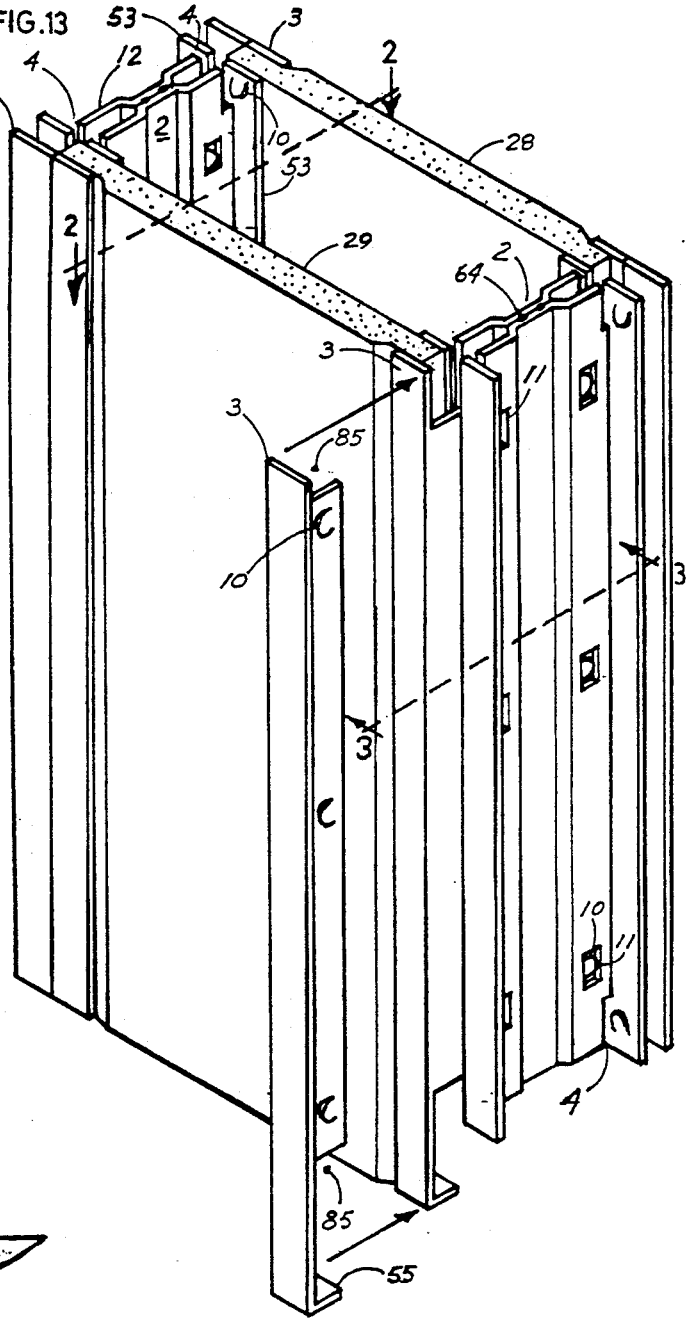
FIG. 13 An exploded isometric of a wall panel arrangement to snap-lock togther wall panels of dissimilar materials.

FIG. 13 is an isometric of a wall panel assembly that employs the snap-together features previously shown, to permit dissimilar materials to be used for practical or decorative reasons. The separators 2 shown here are made up of two pre-formed metal strips that have two off-set longitudinal edges 12 that create forks when their central portions are welded 64 back to back. The off-set edges 12 terminate in outwardly turned feet 53 that act as back-ups for the panels 28 and 29. The feet 53 have tongues 10 intermittently and precisely spaced at their top and bottom extremities that coincide with intermittently spaced recesses 11 in the top and bottom channels flanges 50 and 52. The forks 12 are also slotted 4 at their top and bottom ends with one side of each slot tangent to the inward-turned part 53 so as to fit over the flanges 50 and 51 of the channels 6 and 9. Retainer strips 3 are angle-shaped and one leg 54 of the strip has intermittently spaced tongues 11 that coincide with the recesses in the fork tines 12. Side 90 of the retainer strip 3 has an inwardly turned foot 65 at its bottom extremity that acts as a support for the panels 28 and 29 when the retainer strips 3 are inserted into the forks 12 and the tongues 10 are retained in the recesses 11 of the forks 12.

Figure 14:
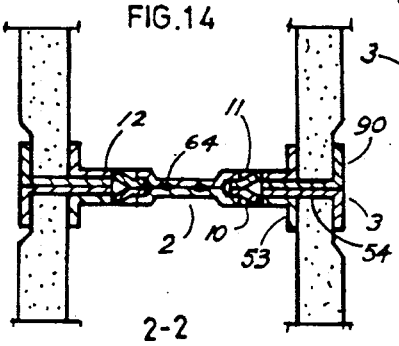
FIG. 14 A section of the panel shown in FIG. 13 to show the snap-lock arrangement.

FIG. 14 is section 2—2 of the separator shown in FIG. 13.

Figure 15:
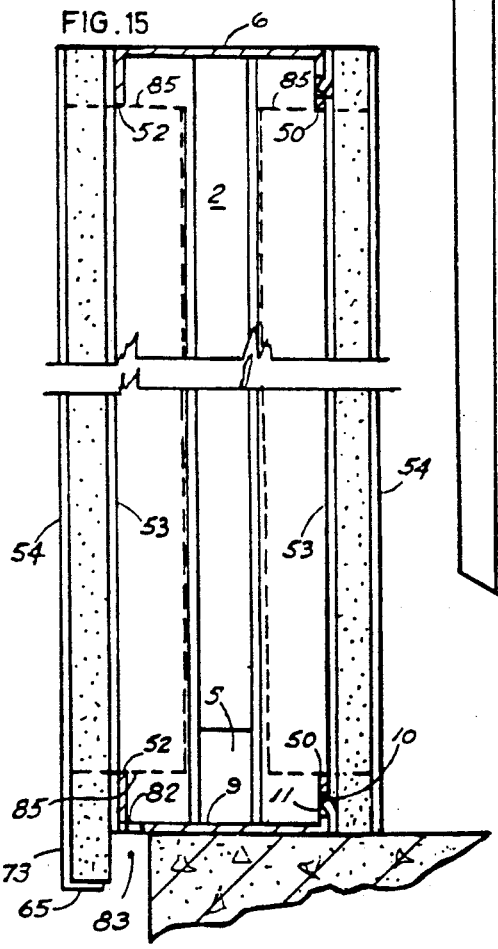
FIG. 15 A cross-section showing the assembly of the components in FIG. 13 assembled with a top and bottom channel.

FIG. 15 is section 3—3 of the panels as assembled with the channels 6 and 9.

Figure 16:
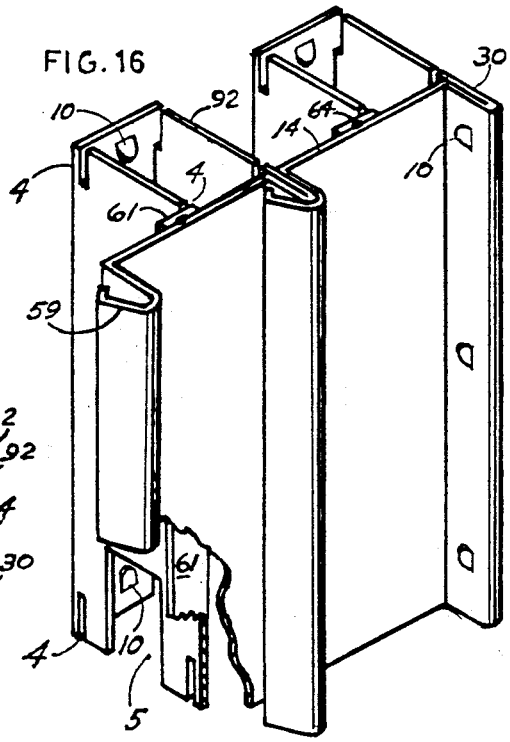
FIG. 16 An isometric showing a structural box form separator integral with a panel useful for a wall or roof.

FIG. 16 is an isometric showing two adjacently disposed panels and each panel is formed from a single piece of sheet metal. These panels consist of a structural box form separator 2 which is welded 64 between the flange 61 and the plane central portion 14. The box form separator 2 provides both vertical and horizontal strength for both wall and roof loads. Slots 4 in the top and bottom corners of the box form separator 2 with one side of the slots 4 adjacent to either box side 16 or in line with the inside face of the flange 61 and these slots 4 provide stability to the assembly when they are snug fit over the flanges 50 and 52 of the top and bottom channels 6 and 9.

FIG. 17 is a plan detailing the conformation of the panel shown in FIG. 16 which describes the box-shaped section of the separator 2. Extending from the right-hand side 92 of the box section is a hairpin flange 30 whose left-hand side has pre-formed tongues 10 intermittently spaced along the length of the flange 30. Flange 30 turns left at a 90-degree angle to form the plane central portion 14 of the exterior panel 7 which terminates along its longitudinal edge in a channel-shaped flange 59 with the tip turned inwardly along its longitudinal edge as a hook 13. The left-hand side of the separator 2 has a flange 61 turned outwardly at a 90-degree angle and welded 64 to the plain central portion 14. Side 16 of the separator 2 has tongues at the top and bottom for snap-locking to flanges 50 of the channels 6 and 9 plus the slots 4 to accomodate assembly with the channels 6 and 9 to maintain the snap connections. FIG. 16 shows two adjacently disposed panels with the hook-shaped flange 59 snapped over the hairpin-shaped flange 30 and its inwardly turned edge 13 engaged under the protruding tongues 10 to lock the consecutively disposed panels together along their longitudinal sides. The sides 16 provide the means of fastening a finished inside panel.

Figure 18:
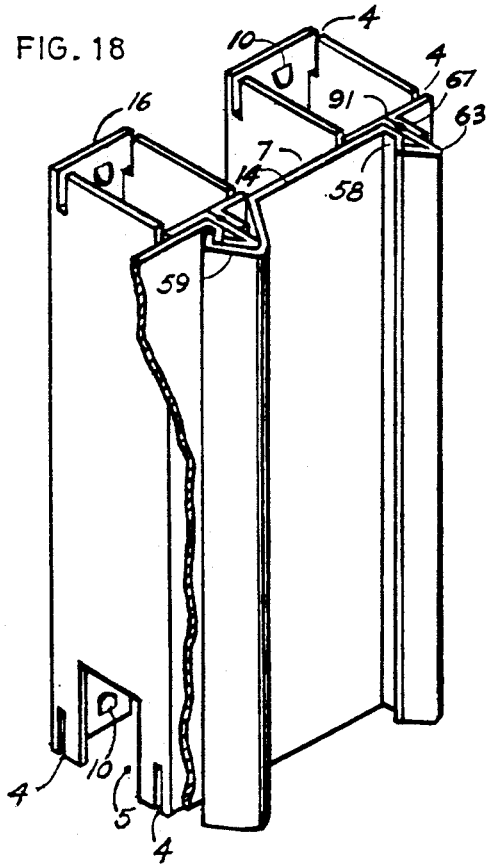
FIG. 18 An isometric of box form separators used like studs to which panels can be snap-connected for walls or roofs.

FIG. 18 is a panel design employing a box-shaped separator 2 which has a hook-shaped flange 63 extending from the center of the side 91 of the box-shaped separator and the flange 63 is welded 64 to an el-shaped flange 67 formed from the side 91. The box section separator 2 has slots 4 at the top and bottom extremities with one side of the slots adjacent to the side 16 or 91 for maintaining the snap-connection effected when the tongues 10 in the top and bottom of the side 16 are engaged in the recesses in the flange 50 of the top and bottom channels 6 and 9.

FIG. 19 details the conformation of the box form separators 2 and the outside panels 7. The outside panel 7 has a right-hand longitudinal edge flange turned inward with an angled off-set on its extreme edge that is turned inward. On the opposite edge of the panel's plane central portion 14 is a channel-shaped flange 59 turned inward that terminates in a hook 13 that turns inward into the channel. The separators 2 are placed consecutively apart on the bottom channels 9 on centers dictated by the width of the outside panels 7 and recesses 11 in the channel flanges 50 and 52 of the bottom channel are on the same centers dictated by the width of panel 7. When two or more box form separators are disposed on the bottom channel and snap-connected, the outside panels can be snap fastened to the separators 2 by placing the right-hand flange 58 of the panel 7 under the edge of the separator flange 63 and then forcing the flange 59 over the next consecutive separator flange 63. Flange 59 is snuggly fitted over the flange 63 so that when the hook 13 of the flange 59 is forced over the flange 63, the channel of the flange 59 is sprung open to allow the hook 13 to drop under the flange 58, locking the consecutive panels together with the separators.

Figure 22:
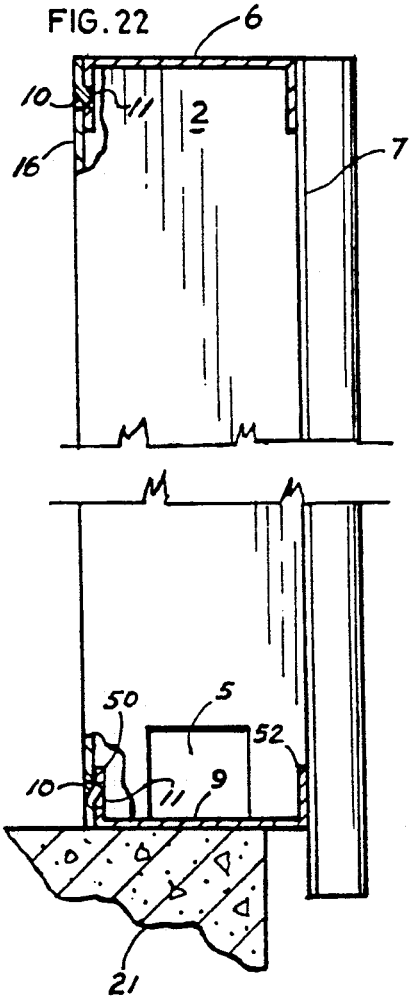
FIG. 22 A section of the panel arrangement shown in FIG. 20 assembled with the top and bottom channels.
Figure 20:
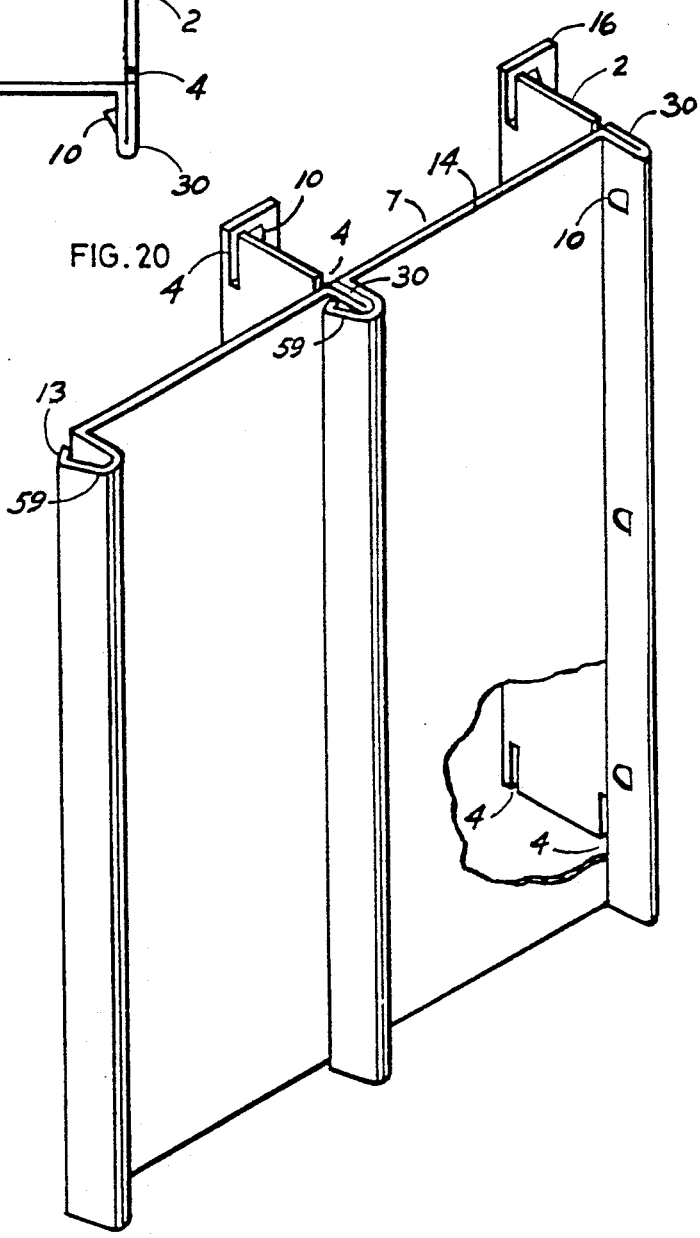
FIG. 20 An isometric of a simple structural form integral with a panel.

FIG. 20 is an isometric of a snap-together panel design that combines a simple el-shaped separator 2 that serves as a structural member with an exterior panel 7. The separator flange 16 provides a surface for attaching an interior panel and also has tongues 10 at the top and bottom extremities to engage the recesses in the flanges 50 of the top and bottom channels 6 and 9 when assembled as shown in FIG. 22. The separator 2 has slots 4 to maintain the snap connection when engaged with the top and bottom channels 6 and 9.

Figure 21:
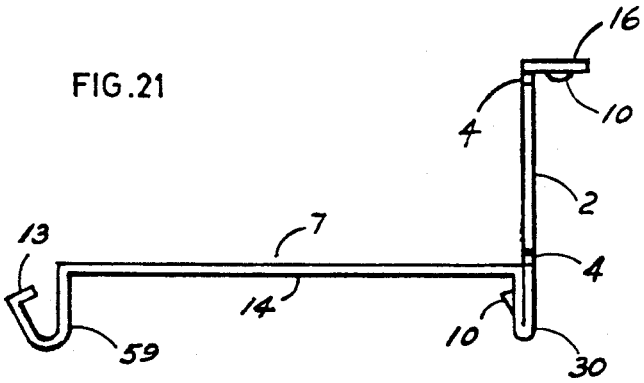
FIG. 21 A plan detailing the conformation of the panel arrangement shown in FIG. 20

FIG. 21 is a plan of the panel conformation shown in FIG. 20 and shows the flange 16 turned at right angles to the separator 2 and it should be noted that the flange 16 could be turned inwardly or outwardly. The separator 2 has slots 4 at its extremities with one side of the slots adjacent to the flange 16 or the plane central portion 14 of the exterior panel 7. The separator 2 is extended in a hairpin-shaped flange 30 that has intermittently spaced tongues 10 protruding from the inner side of the flange 30. The plane central portion 14 of the exterior panel 7 extends from the flange 30 at a right angle to a hook-shaped flange 59 that terminates in a barb 13. When adjacently disposed panels are snapped onto the bottom channels, the flange 59 is forced over the adjacent mating flange 30 to the point where the barb 30 snaps under the tongues 10 in the flange 30 and as the hook-shaped flange 59 is a snug fit over the flange 30, the two flanges are securely engaged.

FIG. 22 illustrates in section the engagement of the panels 7 with the channels 6 and 9.

Figures 23, 24, 25, 26, 27:
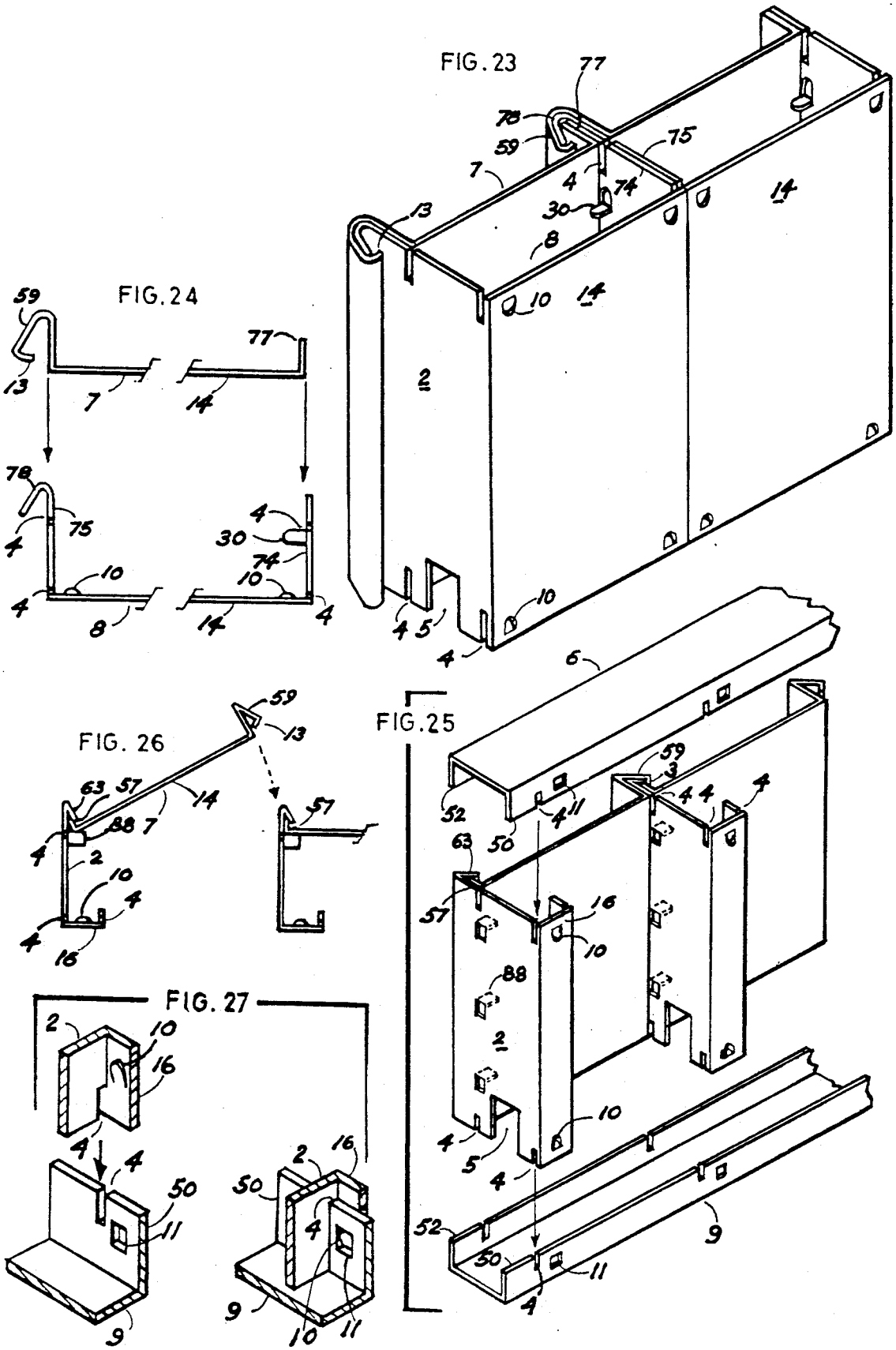
FIG. 23 An isometric of channel shapes with snapped-in exterior panels for walls or roofs.
FIG. 24 A detail showing the conformation of the components shown in FIG. 23.
FIG. 25 An exploded isometric showing the components of a simple structural form separator employed like a stud with a snap-together outside panel for walls or roofs.
FIG. 26 A detailed plan of the components shown in FIG. 25.
FIG. 27 A detail of the slot arrangement of the panel shown in FIG. 25.

FIG. 23 is an isometric showing panels made of an interior panel 8 and an exterior panel 7. The interior panel 8 as shown in detail in FIG. 24 has a plane central portion 14 with a right-hand longitudinal flange 74 that has two slots 4 precisely spaced to accomodate flanges 50 and 52 of the top and bottom channels 6 and 9. The flange 74 has a plane 93 extending outward from the slot most outwardly from the plane central portion 14 and this plane 93 is the same height as the right-hand flange 77 of the exterior panel 7. In flange 74 are intermittently spaced tongues 30 that project inward with the outward side of the tongue 30 tangent to the outward side of the outward slots 4 and these tongues 30 act as retainers for the exterior panels 7 as shown in FIG. 23. The plane central portion 14 of the interior panel 8 has tongues 10 in its four corners for snap-connecting to the recesses 11 in the top and bottom channel flanges 50 and 52. The left-hand flange 75 of the plane central portion 14 of the interior panel 8 has slots 4 identically spaced as those in its opposing flange 74 and extending outward from the most outwardly slot 4 is a hook 78. Exterior panel 7 has a plane central portion 14 that has an inwardly turned flange 77 on its longitudinal right-hand edge that is the same height as the extension 93 of the outside panel 8, and on its left-hand edge it has a channel-shaped flange 59 that terminates in a barb 13. When two or more interior panels 8 are adjacently disposed and snap-connected to the bottom channel 9, the exterior panel 7 can be snapped into place as shown in FIG. 23 by tipping the flange 77 under the hook 78 of the interior panel so that the barb 13 hooks under the hook-shaped flange 78 of the exterior panel 8. The tongues 30 are intermittently spaced in the flange 74 to support the inside edge of the plane central portion of the exterior panel 7 and the outward side of the tongue 30 is tangent to the outward side of slots 4 in the flange 74.

FIG. 24 is described in the detail presented immediately above in FIG. 23.

FIG. 25 is an isometric which illustrates a snap-together panel design that has a simple el-shaped separator 2 that serves as a structural member which has a channel-shaped flange 16 that provides a surface for attaching an interior panel. At the top and bottom extremities of the flange 16 are tongues 10 to engage the recesses 11 in the flanges 50 and 52 of the top and bottom channels 6 and 9. On the side of separator 2 opposing the channel 16 is a hooked flange 63 turned inward, extending out from the slot 4 outward from the channel 16. The separator 2 has three slots 4 in each transversal edge ends. Two slots have one side adjacent to the channel 16 and the third slot is in the plane portion of the separator 2 at a point that accomodates the channel flange 52 when the separator is snapped on the channels 6 and 9. Adjacent to the outward side of the outward slot 4 are intermittently spaced tongues 88 with the outward side of the tongue 88 adjacent to the outward side of slot 4. These tongues 88 extend inwardly from the plane central portion 14 of the separator 2.

FIG. 26 is a plan that details the conformation of the separator 2 and the exterior panel 7. The exterior panel 7 has a plane central portion 14 with a hook-shaped flange 59 on the right-hand side longitudinal edge and a plane flange 57 on the left-hand longitudinal edge. Because this design could be used where extremely lightweight construction would be desirable, the slots 4 are not typical of the previously described panel designs. To provide stability in a lateral direction as well as to maintain pressure between the part having the tongues and the channel flanges 50 and 52 that have the recesses 11, the flanges are shown slotted only half the height of the flanges 50 and 52, and the part such as the separator 2 is also notched half the height of the channel flanges 50 and 52 so that when the two parts are interconnected as shown in FIG. 27, the parts are locked in three directions.

FIG. 27 illustrates how, when two or more separators 2 are snapped onto the top and bottom channels 6 and 9, the exterior panel 7 that has the plane flange 57 is tipped under the hooked flange 63 of the separator 2 and between tongue 88 and subsequently the hooked flange 59 is forced over the hook 63 of the next consecutive panel to the point where the barb 13 of the hook 59 hooks under hook 63 of the separator 2.

I claim:

1. A metal building structure comprising:

a. a plurality of upwardly facing U-shaped bottom channels, said channels having apertures in the base of the U-shape for attachment to a foundation, said channel inner vertical legs having a plurality of spaced apertures on prescribed centers therethrough;

b. a plurality of vertical interior and exterior spaced apart wall forming panel elements, said elements each having a vertical inwardly extending flange on each vertical edge of said element, each said flange having a slot in its lower edge to fit over said bottom channel upstanding inner legs, each said interior wall forming element having at least one inwardly inclined tongue in its lower portion to engage one of said apertures in said channels leg, the upper portion of said flange in said interior wall forming element having a slot therein; each said interior wall forming element having at least one inwardly inclined tongue formed in its upper portion, each said flange on said elements having a recessed portion at its bottom to form a utility raceway when elements are joined;

c. a plurality of downwardly facing U-shaped top channels fitted within the top portions of said wall forming elements, said top channel inner-depending leg having a plurality of spaced apertures therein to receive said inwardly inclined tongues in said upper portion of said interior wall forming element to secure said top channel on said wall forming elements, said top channel upper surface having a plurality of apertures on prescribed centers therein adjacent said top channel exterior depending leg;

d. roof means comprising a box beam extending between two opposing exterior walls, said box beam having a rectilinear cross-section with vertical sides angled to match the pitch of the roof, the top surface having a plurality of apertures on spaced centers therein, the bottom surface of said beam having flanges extending outwardly therefrom at an angle to said top surface depending upon the degree of the pitch of said roof, each said flange having a plurality of apertures on prescribed centers extending along said flange length; a plurality of roofing panels, each panel comprising a spaced apart exterior and interior roofing surface interconnected in the same manner as said vertical wall forming elements, each exterior surface having a length to extend beyond said vertical wall forming elements upon which the outer portion of said roofing panel rests, the outer portion of each interior roof panel surface having at least one outwardly extending tongue to be secured within a respective aperture in said top channel upper surface, the inner portion of each interior roof panel surface having an outwardly extending tongue to be secured within a respective aperture in said flange of said box beam upon which said roof panel rests; and a box beam cap element extending the length of said beam and having a cross-section angular form commensurate with the pitch of said roof means, a plurality of apertures in said cap matching the spacing of said apertures in said box beam top surface and toggle bolts with packing washers for insertion into said apertures to secure said box beam and said roof panels together;

e. each said inwardly extending vertical flange on said interior wall panel element edge being configured as one half of a Y, with apertures on spaced centers in said one half Y upper leg, each pair of abutting interior wall panel element thereby forming a complete Y-shape, said inwardly extending vertical flanges on said exterior wall panel element having a plurality of inwardly extending tongues on spaced centering identical to said spacing of said apertures in said interior wall flange whereby said exterior and interior wall panel elements are securely joined to each other by insertion of a pair of abutting exterior wall flanges into said Y-shape so that said exterior wall flange tongues are secured in said interior wall flange apertures.

2. The structure according to claim 1 wherein one said inwardly extending vertical flange on said interior wall forming element is configured as two vertically spaced apart one half of a Y segment, the other vertical flange on said interior element is configured as the other half of a Y segment and positioned on said other flange to correspond to the spacing of said two one half of a Y segment whereby when two panels are butted together there is formed a complete Y shaped intersection of said two half Y segments on the flange of one wall element and the said one half Y segment on the flange of the abutting wall element, each one half Y segment having a single aperture on its upper leg.

3. The structure according to claim 1 wherein said upper leg of each one half of a Y segment has its extremity bent inward whereby when two interior wall elements are abutted together to form said Y shape, and said flanges on two abutting exterior wall elements are inserted into said Y, said tongues on said exterior wall flanges are secured by said inwardly bent extremities.

* * * * *